US007109785B2

(12) United States Patent
Derksen

(10) Patent No.: US 7,109,785 B2
(45) Date of Patent: Sep. 19, 2006

(54) CURRENT SOURCE FOR GENERATING A CONSTANT REFERENCE CURRENT

(75) Inventor: Sven Derksen, Villach (AT)

(73) Assignee: Infineon Technologies AG, Munich (DE)

( * ) Notice: Subject to any disclaimer, the term of this patent is extended or adjusted under 35 U.S.C. 154(b) by 46 days.

(21) Appl. No.: 10/877,960

(22) Filed: Jun. 25, 2004

(65) Prior Publication Data

US 2005/0030091 A1 Feb. 10, 2005

(30) Foreign Application Priority Data

Jun. 25, 2003 (DE) ..... 103 28 605

(51) Int. Cl.
*G05F 1/10* (2006.01)

(52) U.S. Cl. ..... 327/543; 323/315

(58) Field of Classification Search ..... 327/540, 327/541; 323/315

See application file for complete search history.

(56) References Cited

U.S. PATENT DOCUMENTS 4,603,290 A * 7/1986 Shinomiya ..... 323/315
5,252,910 A * 10/1993 Agaesse ..... 323/315
6,057,727 A * 5/2000 Dautriche et al. ..... 327/543
6,121,764 A * 9/2000 Stockstad ..... 323/315
6,249,175 B1 * 6/2001 Ebana ..... 327/538
6,313,692 B1 * 11/2001 Pease ..... 327/538
6,590,271 B1 7/2003 Liu et al. ..... 257/510
2002/0145411 A1 * 10/2002 Sirito-Olivier ..... 323/315
2003/0098735 A1 * 5/2003 Jaussi et al. ..... 327/530

FOREIGN PATENT DOCUMENTS

DE 34 47 002 A1 7/1985

OTHER PUBLICATIONS

Geiger et al., "VLSI Design Techniques for Analog and Digital Circuits", McGraw-Hill, International Edition 1990, pp. 363-365, (3 pages).

* cited by examiner

*Primary Examiner*—Timothy P. Callahan
*Assistant Examiner*—Thomas J. Hiltunen
(74) *Attorney, Agent, or Firm*—Maginot, Moore & Beck

(57) ABSTRACT

Current source for generating a constant reference current having an amplifier circuit, which outputs a negative feedback voltage, present across a first resistor, in inverted amplified fashion as amplification output voltage; a first voltage/current converter, which generates a current in a manner dependent on the amplifier output voltage; a first current mirror circuit, which mirrors the current generated by the voltage/current converter to form a mirrored current which flows through the first resistor in order to generate the negative feedback voltage; and having a second current mirror circuit, which mirrors the current generated by the voltage/current converter to form the reference current.

20 Claims, 7 Drawing Sheets

1st embodiment

2nd embodiment

3rd embodiment

4th embodiment

CURRENT SOURCE FOR GENERATING A CONSTANT REFERENCE CURRENT

BACKGROUND

The invention relates to a current source for generating a constant reference current, in particular for application specific integrated circuits in CMOS technology.

Constant-current sources are provided for supplying a current which, besides being largely independent of operating voltage changes, temperature changes and long-term changes, is independent of the output voltage. Constant-current sources therefore have a very high internal resistance.

In integrated circuits analogue reference current sources are: frequently used for generating bias currents. Current sources of highly diverse designs are known. A constant-current source may be realized as an active two-terminal network having an internal resistance of $R_i=\infty$ by means of negative current feedback or as an active two-terminal network with a regulated clamping current. Constant-current sources also include what are known as current mirror circuits. Current mirrors are an electronic circuit having transistors which serve to generate constant currents from a reference current. Current mirror circuits can be constructed from bipolar transistors or from MOS field-effect transistors, the base or GATE terminals of the two transistors in each case being connected to one another.

In many technical applications, it is important to generate a bias current $I_{BIAS}$ which is independent of fluctuations in the supply voltage. It is important, therefore, that the current source for generating the reference currents or bias currents has a relatively low sensitivity toward fluctuations in the supply voltage $V_{DD}$. A low supply voltage sensitivity of the reference current source is an important prerequisite for many applications, for example for amplifiers, comparators or oscillators which receive the generated reference current. The oscillator of a phase locked loop PLL generates a signal frequency that is as far as possible independent of the supply voltage. The frequency changes of the phase locked loop brought about by supply voltage fluctuations lead to undesirable jitter of the output signal.

Application specific integrated circuits ASICs in many cases have both a digital circuit section and an analogue circuit section. In this case, the reference current source is integrated within the analogue circuit and generates reference or constant currents for various analogue circuit components, such as, for example, amplifiers, comparators or oscillators. The digital circuit section of the application specific integrated circuit ASIC is clocked with a synchronous clock signal. Both the analogue circuit section and the digital circuit section receive an external supply voltage and are coupled to one another via common power supply lines. What is more, both the analogue circuit section and the digital circuit section are integrated on the same substrate. Supply voltage fluctuations brought about by switching operations in the digital circuit section (spikes) are transmitted to the analogue circuit section via the supply voltage lines. Furthermore, noise brought about by the switching operations within the digital circuit section is transmitted via the common substrate to the analogue circuits, in particular the analogue constant-current source. Therefore, a high PSRR (power supply rejection ratio) of the constant-current source is necessary as the degree of integration increases.

$$PSS = \frac{\frac{\Delta I_{OUT}}{I_{OUT}}}{\Delta V_{DD}} \quad [\%/\text{volts}] \tag{1}$$

where PSS denotes the power supply sensitivity, $I_{OUT}$ denotes the output current of the current source and $V_{DD}$ denotes the supply voltage of the current source.

The lower the power supply sensitivity PSS, the less sensitive the current source is toward fluctuations in the supply voltage $V_{DD}$.

The sensitivity PSS of the current source toward fluctuations in the supply voltage is determined by the circuitry construction of the current source.

FIG. 1 shows a current source which is also referred to as a bootstrapped current source. This current source is described for example in R. L. Geiger, P. E. Allen, N. R. Strader: "VLSI design techniques for analog and digital circuits", McGraw-Hill, International Edition 1990, pages 363–365. The bootstrapped current source BSQ according to the prior art as is shown in FIG. 1 generates a constant reference current ($I_{BIAS}$) It has two supply voltage terminals $V_{DD}$ and $V_{SS}$. The negative supply voltage terminal $V_{SS}$ is connected to ground GND, for example. The current source BSQ contains an amplifier circuit AMP having two complementary MOSFET transistors (P1, N1). The GATE of the MOSFET transistor N1 is connected to an input E of the amplifier circuit AMP. The amplifier circuit AMP has an output A, which is connected to the GATE of a MOSFET field-effect transistor N2. The MOSFET transistor N2 forms a voltage/current converter which generates a current $I_2$ in a manner dependent on the amplifier output voltage. The current $I_2$ flows away through a resistor R1 to the negative supply voltage terminal $V_{SS}$. As a result, a negative feedback voltage $V_{R1}$ is dropped across the resistor R1. Said negative feedback voltage $V_G$ is applied to the input E of the amplifier circuit AMP. The current I2 flowing through the voltage/current converter N2 flows through a complementary PMOS field-effect transistor P2, which mirrors the current I2 on the one hand via the PMOS transistor P1 and on the other hand via the PMOS transistor $P_{OUT}$. The mirroring has the effect that the currents I1, I2 and the generated reference current $I_{OUT}$ are equal:

$$I_1=I_2=I_{OUT} \tag{2}$$

The current source illustrated in FIG. 1 operates with a negative feedback voltage $V_6$ across the resistor R1, via which the operating point of the current source is adjustable. The rise in the negative feedback voltage $V_6$ decreases the output voltage $V_A$ (present at the output A) of the amplifier AMP in amplified fashion on account of the inverting of the amplifier AMP.

$$V_A=-K*V_G, \tag{3}$$

The field-effect transistor N2 forms a SOURCE follower, so that the voltage present across the resistor R1 decreases to the same extent as the output voltage of the amplifier AMP.

$$V_6=-K'*V_A(K'\approx 1) \tag{4}$$

The two MOSFET transistors N1, N2 in each case operate in the saturation region, the currents I1, I2 flowing through being equal in magnitude on account of the current mirroring.

The output voltage of the amplifier circuit AMP results from the sum of the two GATE-SOURCE voltages of the MOSFET transistors N1, N2:

$$V_A = V_{GS\,N1} + V_{GS\,N2} \tag{5}$$

The output voltage of the amplifier circuit $V_A$ thus results as:

$$V_A = V_{T1} + \Delta V_1 + V_{T2} + \Delta V_2 \tag{6}$$

where $V_{T1}$ denotes the threshold voltage of the MOS transistor N1, $V_{T2}$ denotes the threshold voltage of the MOS transistor $N_2$, ΔV1 denotes the overdrive voltage of the transistor N1 and ΔV2 denotes the overdrive voltage of the transistor N2.

In the saturation region, it furthermore holds true that:

$$\Delta V1 = \sqrt{\frac{I1}{K1\frac{W1}{L1}}} \tag{7}$$

$$\Delta V2 = \sqrt{\frac{I2}{K2\frac{W2}{L2}}} \tag{8}$$

where I1, I2 denote the currents flowing through the transistors N1, N2,

K1, K2 denote the transconductance of the transistors N1, N2,

W1, W2 denote the channel widths of the transistors N1, N2, and

L1, L2 denote the channel lengths of the transistors N1, N2.

The DRAIN-SOURCE voltage at the PMOS field-effect transistor P1 results from the difference between the applied supply voltage $V_{DD}$ and the output voltage at the output A of the amplifier circuit.

$$V_{DS} = V_{DD} - V_A \tag{9}$$

The output voltage at the output A of the amplifier circuit amounts to approximately 1.1 V in the case of the conventional circuit illustrated in FIG. 1. For a sufficient precise current mirroring, the DRAIN-SOURCE voltage at the current mirror transistor P1 must not fall below a certain voltage, for example a voltage of 0.4 V.

FIG. 2 shows the principle of a current source coupled through by means of a negative feedback voltage from the prior art as is illustrated in FIG. 1. The mirrored current I1 is, on the one hand, a function of the current I2 which flows through the current converter N2 and which brings about a voltage drop $V_{R1}$ across the resistor R1 and controls the MOSFET transistor N1. The condition that the two currents I1, I2 are identical furthermore holds true by virtue of the current mirroring at the two PMOS transistors P1, P2. The two operating points ARB1, ARB2 lie at the point of intersection of the two characteristic curves. The operating point 2 is a non-desired operating point at which the two currents I1=I2=zero. The desired operating point is the operating point $ARB_1$, which is adjustable by means of the resistor R1.

The relationship between the two currents I1, I2 is given by the following equation:

$$I_2 = \frac{V_{T1} + \Delta V_1}{R_1} = \frac{V_{T1}}{R_1} + \frac{1}{R_1}\sqrt{\frac{I_1}{K_1 * \frac{W_1}{L_1}}} \tag{10}$$

One disadvantage of the conventional current source BSQ illustrated in FIG. 1 is that, on account of the relatively high output voltage $V_A$ required at the output A of the amplifier circuit, the required supply voltage $V_{DD}$ is likewise relatively high and of an order of magnitude of approximately 1.5 V.

A further disadvantage of the current source illustrated in FIG. 1 is that the sensitivity PSS toward the supply voltage fluctuations $\Delta V_{DD}$ is relatively high and cannot be increased by additional cascading of the current mirror circuit P1, P2 and P3, $P_{out}$ because this would lead to an even higher supply voltage $V_{DD}$.

SUMMARY

Therefore, the object of the present invention is to provide a current source for generating a constant reference current which requires a lowest possible supply voltage $V_{DD}$ and at the same time is as insensitive as possible toward supply voltage fluctuations.

Embodiments of the invention include those set forth in the paragraphs below.

The invention provides a current source for generating a constant reference current having an amplifier circuit, which outputs a negative feedback voltage $V_6$, present across a first resistor, in inverted amplified fashion as an amplifier output voltage $V_7$, a first voltage/current converter, which generates a current in a manner dependent on the amplifier output voltage, a first current mirror circuit, which mirrors the current generated by the voltage/current converter to form a mirrored current, which flows through the first resistor in order to generate the negative feedback voltage $V_6$ and having a second current mirror circuit, which mirrors the current generated by the voltage/current converter to form the reference current.

In a preferred embodiment of the current source according to the invention, the amplifier circuit is an inverting amplifier having a first MOSFET, at whose GATE the negative feedback voltage is present, and having a MOSFET constructed complementarily with respect to the first MOSFET.

The first MOSFET of the amplifier circuit preferably has a SOURCE terminal connected to a negative supply voltage ($V_{SS}$) of the current source, and a drain terminal connected to an output terminal (A) of the amplifier circuit.

The second MOSFET of the amplifier circuit preferably has a SOURCE terminal connected to a positive supply voltage ($V_{DD}$) of the current source, and a drain terminal connected to the output terminal (A) of the amplifier circuit.

In a preferred embodiment of the current source according to the invention, the first current mirror circuit has a first MOSFET having a drain terminal connected to the voltage/current converter, and having a SOURCE terminal connected to the positive supply voltage ($V_{DD}$) of the current source.

In this case the first current mirror circuit preferably contains a second MOSFET having a drain terminal connected to the first resistor, and having a source terminal connected to the positive supply voltage ($V_{DD}$) of the current source.

The GATE of the first MOSFET of the first current mirror circuit is preferably connected to the GATE of the second MOSFET of the first current mirror circuit.

In a preferred embodiment of the current source according to the invention, the GATE of the first MOSFET of the first current mirror circuit is connected to the GATE of the second MOSFET of the amplifier circuit for the purpose of forming a third current mirror circuit.

In a particularly preferred embodiment of the current source according to the invention, the first voltage/current converter has a MOSFET having a GATE connected to the output of the amplifier circuit, a SOURCE terminal connected to the negative supply voltage ($V_{SS}$) of the current source via a second resistor, and having a drain terminal connected to the SOURCE terminal of the first MOSFET of the first current mirror circuit.

In a particularly preferred embodiment, the resistance of the first resistor is adjustable.

In a further preferred embodiment of the current source according to the invention, the resistance of the second resistor is adjustable.

In this case, the resistance of the second resistor is preferably less than the resistance of the first resistor.

In a particularly preferred embodiment of the current source according to the invention, the resistance of the second resistor is equal to zero.

In a preferred embodiment, the resistance of the second resistor is half as large as the resistance of the first resistor.

The first and second resistors are preferably produced from polysilicon.

In a preferred embodiment of the current source according to the invention, a respective cascode current mirror circuit is connected in series with each current mirror circuit.

In the current source according to the invention, a second voltage/current converter is preferably provided, which has a MOSFET having a GATE connected to the output (A) of the amplifier circuit, a SOURCE terminal connected to the negative supply voltage ($V_{SS}$) of the current source via a third resistor, and having a drain terminal connected to a MOSFET constructed in complementary fashion, which generates the GATE voltage for the cascode current mirror circuits.

The current source according to the invention is preferably integrated into an integrated circuit.

Preferred embodiments of the current source according to the invention are described below for the purpose of elucidating features that are essential to the invention, with reference to the accompanying figures.

DETAILED DESCRIPTION

Figure 3:
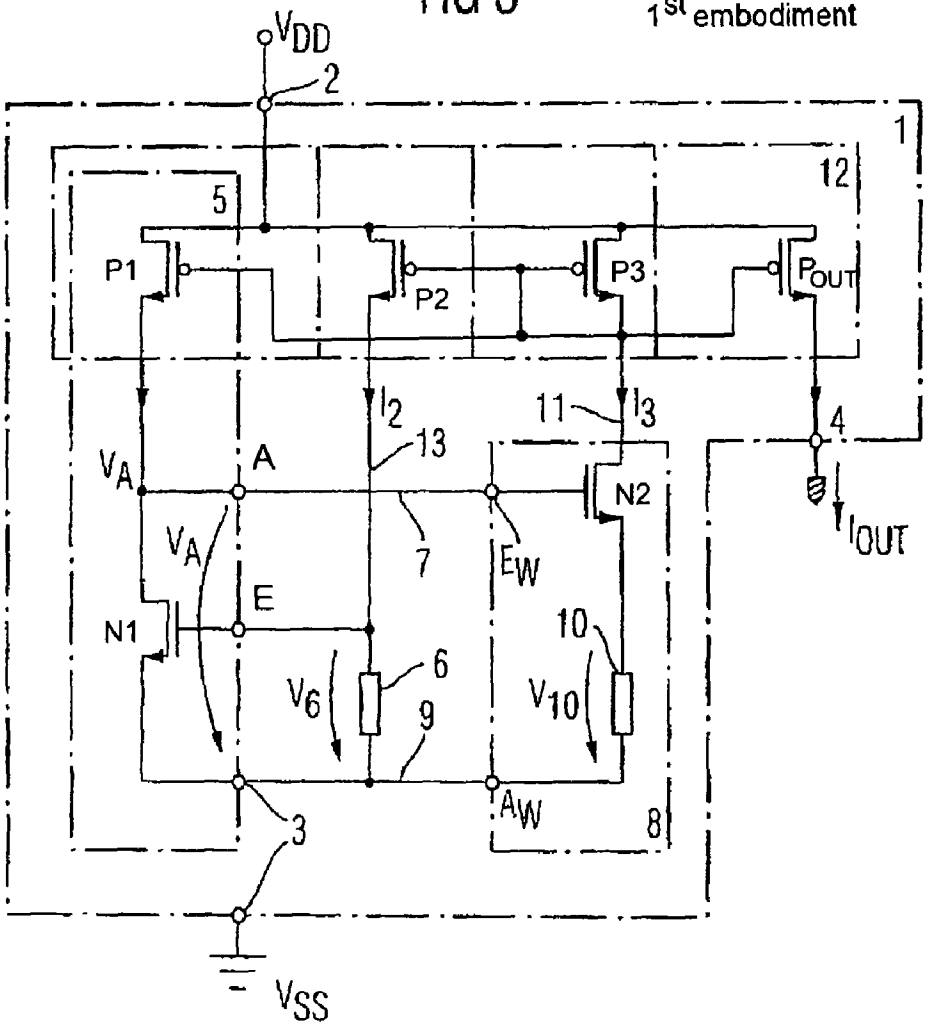
FIG. 3 shows a first embodiment of the current source according to the invention.

FIG. 3 shows a first embodiment of a current source 1 according to the invention. The current source 1 according to the invention has two supply voltage terminals 2, 3. A positive supply voltage $V_{DD}$ is present at the first supply voltage terminal 2 and a negative supply voltage $V_{SS}$ is present at the second supply voltage terminal 3. The negative supply voltage $V_{SS}$ is formed by a ground terminal GND, for example. The current source 1 according to the invention does not have a signal input, but has a signal output 4, via which the constant reference current $I_{OUT}$ generated is output.

The current source 1 according to the invention contains an amplifier circuit 5 which is preferably an inverting amplifier circuit. The inverting amplifier circuit 5 has a signal input E and a signal output A. The amplifier circuit 5 is supplied with the supply voltage via the two supply voltage terminals 2, 3. The amplifier circuit 5 comprises an NMOS transistor N1 and a PMOS transistor P1 constructed complementarily with respect thereto. The GATE terminal of the NMOS transistor N1 is connected to the input E of the amplifier circuit 5. The MOSFET N1 of the amplifier circuit 5 has a SOURCE terminal connected to the negative supply voltage terminal 3, and a DRAIN terminal connected to the output terminal A of the amplifier circuit 5. The second MOSFET P1 of the amplifier circuit 5 has a SOURCE terminal connected to the positive supply voltage terminal 2 of the current source 1, and a DRAIN terminal connected to the output terminal A of the amplifier circuit 5. A negative feedback voltage $V_6$ is present at the input E of the amplifier circuit 5, said voltage being generated by the voltage drop of a current I2 flowing through a resistor 6.

The output A of the amplifier circuit 5 is connected via a line 7 to an input Ew of a voltage/current converter circuit 8. The voltage/current converter circuit 8 has an output Aw, which is connected via a line 9 to the negative supply voltage terminal 3 of the current source 1.

The voltage/current converter 8 converts the amplifier output voltage $V_A$ present at the output A of the amplifier circuit 5 into a current I3. In the preferred embodiment illustrated in FIG. 3, the voltage/current converter 8 comprises a MOSFET N2, the GATE of which is connected to the output A of the amplifier circuit 5 via the line 7. The MOSFET N2 has a SOURCE terminal connected to the negative supply voltage Vss of the current source 1 via a second resistor 10 within the voltage/current converter 8. The MOSFET N2 furthermore has a DRAIN terminal connected via a line 11 to a first current mirror circuit, which comprises the PMOS field-effect transistors P2 and P3. The first current mirror circuit mirrors the current I3 generated by the voltage/current converter 8 to form a mirrored current I2, which flows via a line 13 to the negative feedback resistor 6 and leads to a negative feedback voltage $V_6$ dropped across the latter. The current source 1 according to the invention furthermore contains a second current mirror circuit, which comprises the two PMOS field-effect transistors P3 and $P_{OUT}$. The current I3 generated by the voltage/current converter 8 is mirrored from the PMOS transistor P3 to the PMOS transistor $P_{OUT}$, which outputs the reference current $I_{OUT}$ via the current output 4. Furthermore, the current I3 generated by the voltage/current converter 8 is mirrored into the amplifier circuit 5 via a third current mirror circuit, formed by the PMOS transistors P1 and P3.

Therefore, the following holds true:

$$I_1=I_2=I_3=I_{OUT} \tag{11}$$

The GATE terminal of the PMOS transistor P3 is connected to the GATE terminals of the remaining PMOS transistors P1, P2, and $P_{OUT}$. The PMOS transistor P1 of the current source 1 according to the invention fulfills a dual function, namely on the one hand within the amplifier circuit 5 and on the other hand as part of third current mirror circuit.

The resistances $R_6$, $R_{10}$ of the two resistors 6, 10 are preferably externally adjustable or controllable independently of one another. In this case, the resistance $R_{10}$ of the resistor 10 is less than the resistance $R_6$ of the resistor 6.

$$R_{10}<R_6 \tag{12}$$

In this case, the resistance of the second resistor $R_{10}$ is preferably greater than or equal to zero:

$$R_{10}>0 \tag{13}$$

The resistance $R_{10}$ of the second resistor 10 is preferably half as large as the resistance $R_6$ of the first resistor 6.

A typical dimensioning of the resistance is for example $R_6$=300 kΩ and $R_{10}$=150 kΩ.

The two resistors 6, 10 are preferably produced from polysilicon. The two resistors 6, 10 are preferably situated close to one another.

The method of operation of the embodiment of the current source 1 according to the invention as illustrated in FIG. 3 is described below.

If the negative feedback voltage $V_6$ across the resistor 6 rises, the inverting amplifier 5 ensures that the output voltage $V_A$ at the output A decreases in amplified fashion. The voltage/current converter 8 or SOURCE follower has the effect that the voltage present across the resistor 10 falls to the same extent as the voltage at the output A of the amplifier circuit 5. The resistor 10 brings about a current I3,in which ease the following holds true:

$$I3 = \frac{V_{10}}{R_{10}}, \tag{14}$$

that is to say that as the voltage $V_{10}$ falls, the current I3 generated by the voltage/current converter 8 also falls.

The falling current I3 is mirrored by the first current mirror circuit comprising the PMOS transistors P2, P3, so that the current $I_2$ on the line 13 likewise falls and thus leads to a reduced voltage drop across the resistor 6. This generates the negative feedback voltage $V_G$ applied to the input $E_V$ of the amplifier circuit 5. The negative feedback described above leads to a stable operating point of the current source 1.

The voltage $V_A$ at the output of the amplifier 5 results, in accordance with the following equation, as:

$$V_A=V_{10}+V_{GSN2} \tag{15}$$

The GATE-SOURCE voltage of the transistor N2 results from the sum of the threshold voltage $V_{T2}$ and the overdrive voltage $\Delta_{V2}$, so that equation 15 can be transformed as follows:

$$V_A = \frac{R_{10}}{R_6} * V_G + V_{T2} + \Delta V2 \tag{16}$$

Since the negative feedback voltage $V_G$ at the input of the amplifier circuit 5 is equal to the SOURCE voltage of the NMOS transistor N1, the equation of the equation (16) can be further transformed into:

$$V_A = \frac{R_{10}}{R_6}(V_{T1} + dV_1) + V_{T2} + \Delta V2 \tag{17}$$

Figure 1:
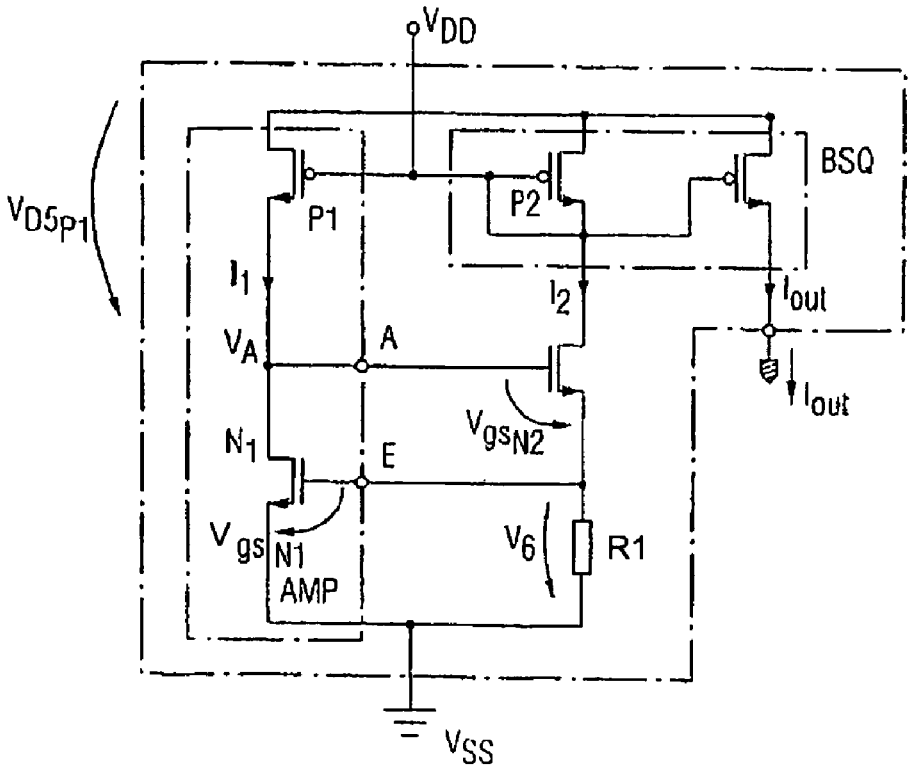
FIG 1 Prior art
FIG. 1 shows a current source according to the prior art.
Figure 2:
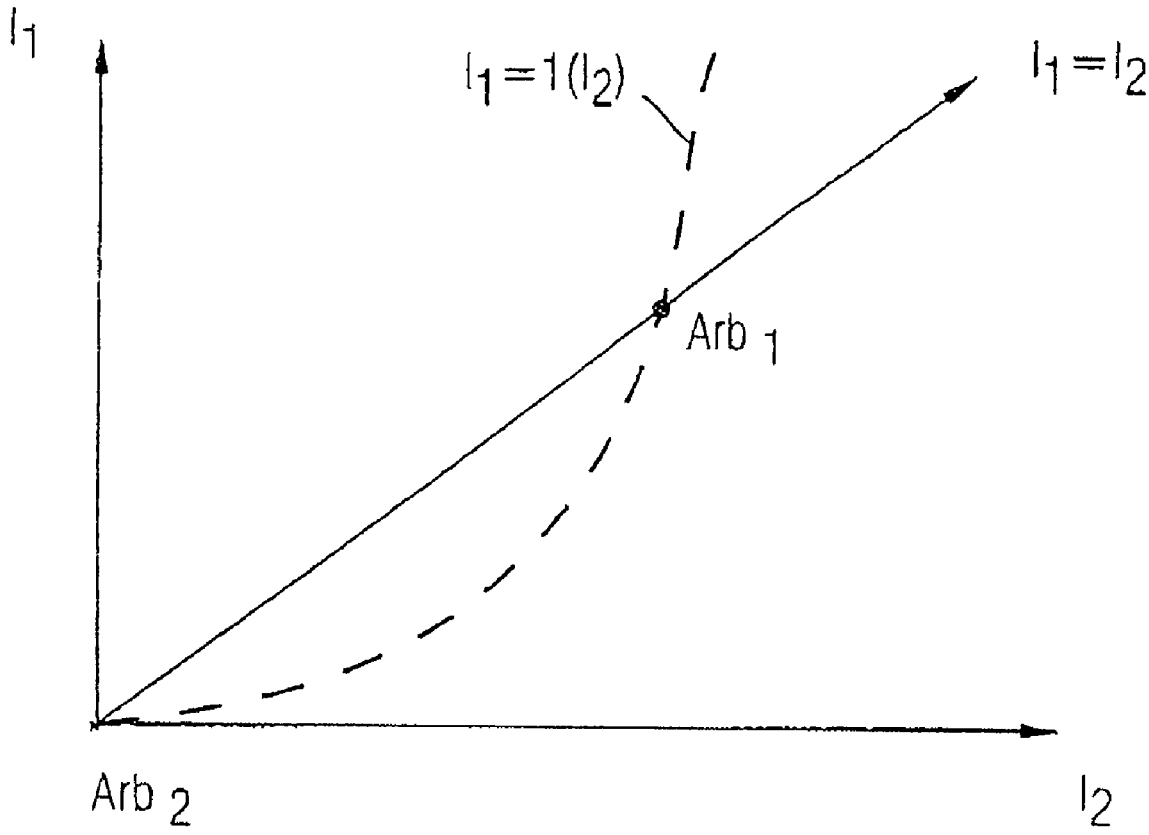
FIG 2 Prior art
FIG. 2 shows a current characteristic curve of a current source according to the prior art as is illustrated in FIG. 1.

If the equations (6) for the conventional current source shown in FIG. 1 are compared with equation (17) for the current source 1 according to the invention as is illustrated in FIG. 3, it emerges that the output voltage $V_A$ at the amplifier circuit 5 in the current source 1 according to the invention is adjustable through the ratio of the resistances of the two resistors 6, 10. By choosing the resistance $R_{10}$ of the resistor 10 to be less than the resistance $R_6$, the output voltage $V_A$ at the output $A_V$ of the amplifier switch 5 is reduced.

With the DRAIN-SOURCE voltage $V_{DS}$ at the PMOS transistor P1 remaining the same, it is thereby possible likewise to reduce the required supply voltage $V_{DD}$ at the supply voltage terminal 2 of the current source 1.

The output voltage $V_A$ can preferably be reduced to a voltage of the order of magnitude of 0.85 V. This output voltage $V_A$ suffices to hold the PMOS transistor N1 in saturation. In comparison with the conventional current source as is illustrated in FIG. 1, a decrease in the supply voltage $V_A$ by approximately 0.2 V is achieved. This in turn has the effect that the voltage supply $V_{DD}$ can also be 0.2 V lower than in a conventional current source as is illustrated in FIG. 1.

If the circuitry construction of the conventional current source as is illustrated in FIG. 1 is compared with the current source 1 according to the invention as is illustrated in FIG. 3, it is evident that the desired reduction of the voltage $V_A$ is achieved according to the invention by the provision of a further current branch formed by the PMOS transistor P3, the NMOS transistor N2 and the resistor 10. This additional current branch contains an additional setting resistor 10, by means of which an additional degree of freedom for setting the output voltage $V_A$ is obtained. The additional degree of freedom is used for reducing the output voltage $V_A$ present at the output A. Whereas the negative voltage feedback occurs directly in the case of the conventional current source in FIG. 1, the current source according to the invention as shown in FIG. 3 effects an intermediate step by firstly mirroring the current 13 onto the current I2, which then brings about the negative feedback voltage $V_6$. In the conventional current source, the negative feedback voltage $V_6$ is not brought about by a mirrored current.

Figure 4:
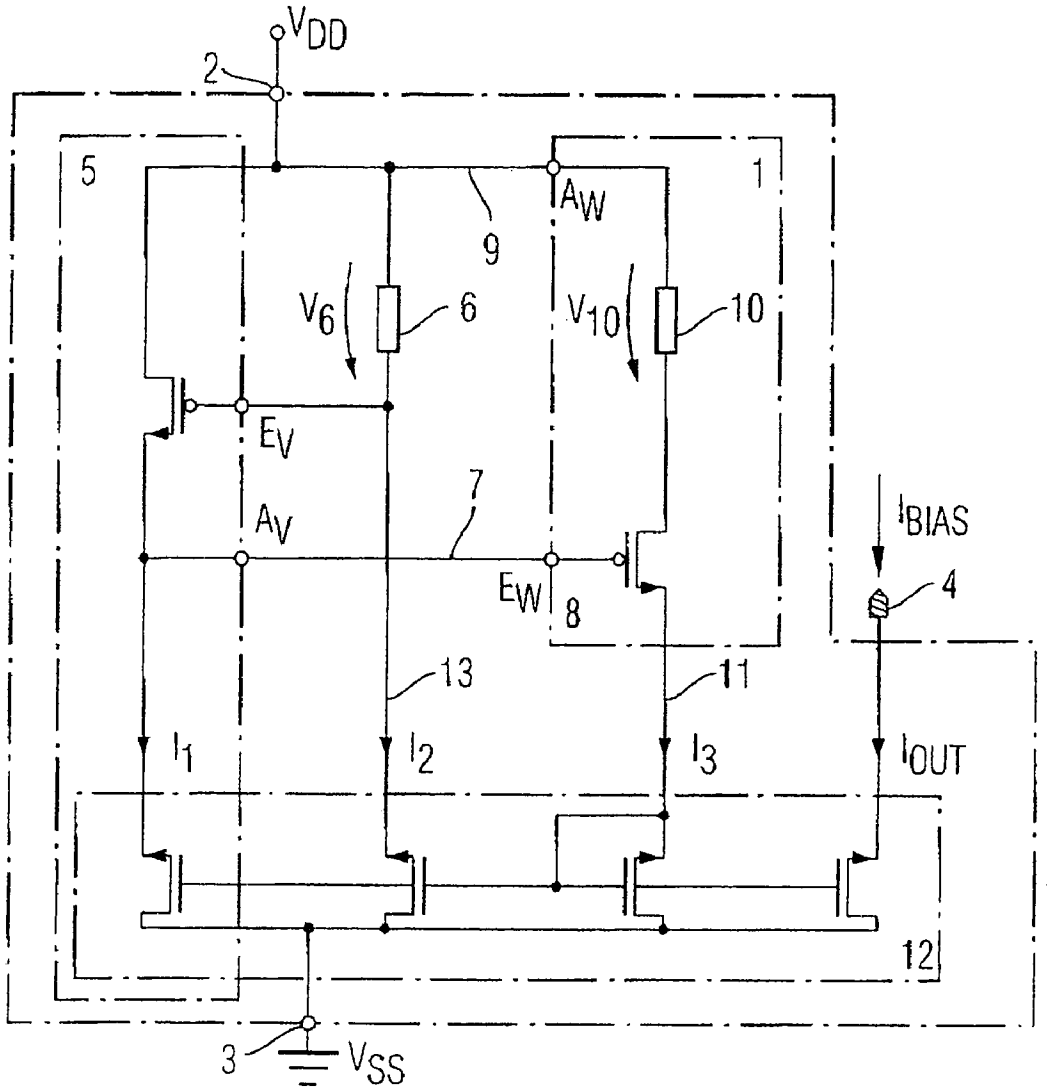
FIG. 4 shows a second embodiment of the current source according to the invention.

FIG. 4 shows a second embodiment of the current source 1 according to the invention. The second embodiment is a complementary embodiment with respect to the first embodiment, that is to say that the embodiment is constructed completely symmetrically with respect to the first embodiment, the PMOS transistor P1 in FIG. 4 forming the function of the MOS transistor N1 in FIG. 3, etc.

Figure 5:
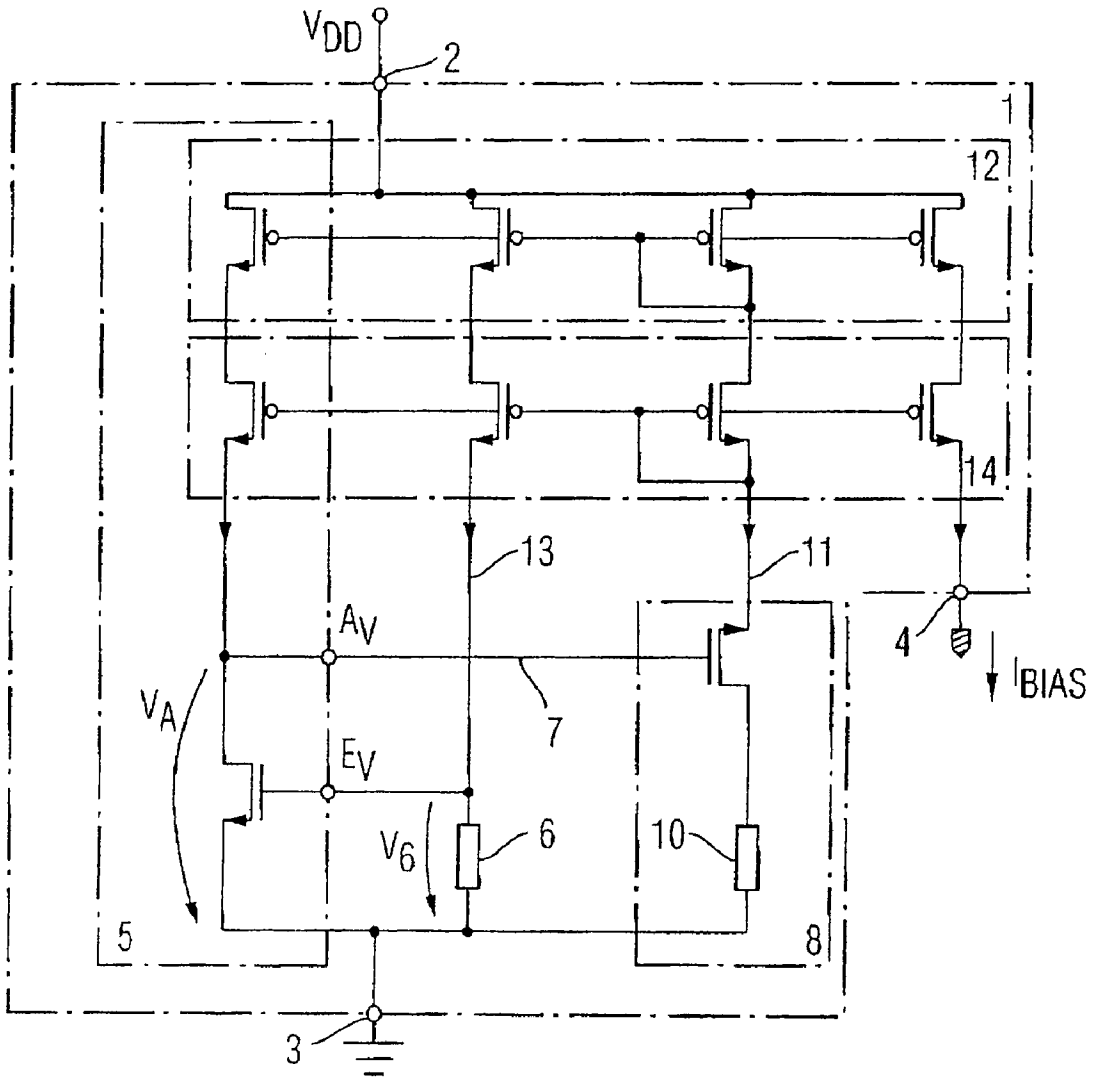
FIG. 5 shows a third embodiment of the current source according to the invention.

FIG. 5 shows a third embodiment of the current source 1 according to the invention. As described in connection with FIG. 3, the invention, through the provision of the additional current branch, affords the possibility of reducing the output voltage $V_A$ at the output of the amplifier stage 5. If the supply voltage $V_{DD}$ is simultaneously kept constant the DRAIN-SOURCE voltage $V_{DS}$ between the drain terminal and the SOURCE terminal of the PMOS transistor P1 in FIG. 3 is increased. This makes it possible to provide an additional cascode current mirror circuit in each case in addition to the current mirror circuit 12-i. In FIG. 5, the current source 1 has a first current mirror circuit comprising the PMOS transistors P3, P2. An additional cascode current mirror circuit, comprising the PMOS transistors P3C, P2C, is connected in series with said first current mirror circuit.

The current source 1 furthermore has a second current mirror circuit 12–2 comprising the PMOS transistors P3, $P_{OUT}$. A further cascode current mirror circuit, comprising the PMOS transistors P3C, $P_{OUT}C$, is connected in series with said second current mirror circuit.

In the same way, a cascode transistor P1C is connected in series with the PMOS transistor P1 and, together with the PMOS transistor P1C, forms a further cascode current mirror circuit.

By virtue of the provision of the cascode current mirror circuits, with the supply voltage $V_{DD}$ remaining the same, the performance of the current source 1 is enhanced, that is to say that the internal resistance $R_i$ of the current source 1 is increased. By virtue of the provision of the cascode current mirror circuits, the sensitivity of the current source 1 toward the supply voltage fluctuations $V_{DD}$ is reduced, that is to say that the PSRR (power supply rejection ratio) is increased. The provision of the cascode stage 14 in the third embodiment illustrated in FIG. 5, comprising the PMOS transistors P1*c*, P2*c*, P3*c*, $P_{OUT}$c, is only possible, with the supply voltage $V_{DD}$ remaining the same, because the invention enables the voltage $V_A$ to be reduced.

Figure 6:
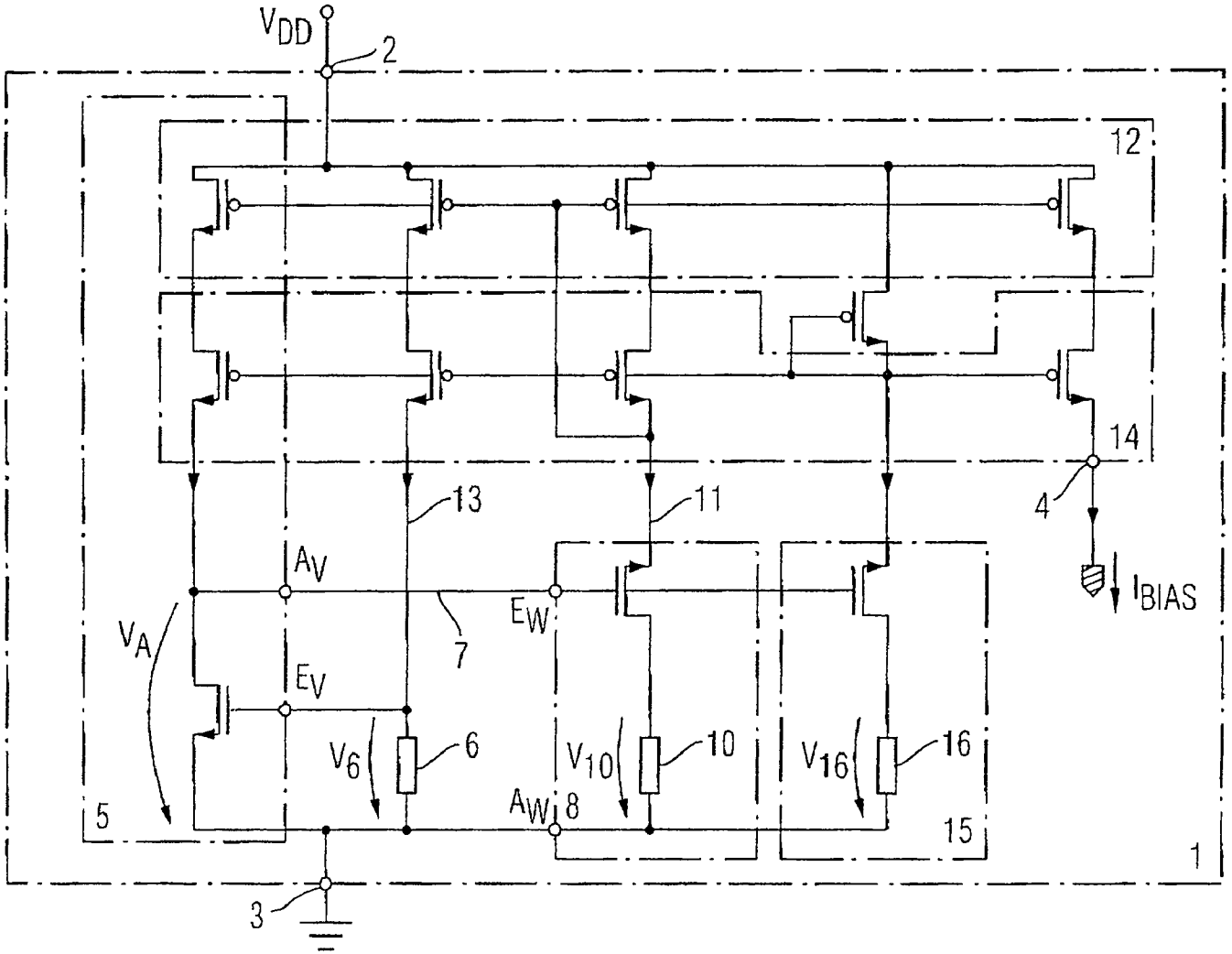
FIG. 6 shows a fourth embodiment of the current source according to the invention.

FIG. 6 shows a further embodiment of the current source 1 according to the invention.

In the case of the current source 1 illustrated in FIG. 6, a second voltage/current converter 15, containing a MOSFET N3 and also a third resistor 16, is provided besides the first voltage/current converter 8. A further PMOS transistor P4 is connected in series with the voltage/current converter 15. The PMOS transistor P4 and the second voltage/current converter 15 form a further current branch within the current source 1. The GATE terminal of the MOSFET transistor N3 is connected to the output $A_V$ of the amplifier circuit 5 and forms a SOURCE follower. The PMOS transistor P4 is constructed complementarily with respect to the MOSFET transistor N3 and supplies the GATE voltage for the cascode current mirror circuit stage 14 comprising the PMOS transistors $P1_c$, $P2_c$, $P3_c$, $P_{OUTc}$. The current $I_4$ flows through the further current branch. This fourth current branch within the current source 1 is preferably constructed identically to the third current branch through which the current $I_3$ flows. The PMOS transistor P4 is designed in such a way as to generate voltage which suffices to hold the transistors in saturation. A scaling of the currents $I_3$, $I_4$ flowing through the two current branches can be achieved for the setting of the resistors 10, 16.

Figure 7A:
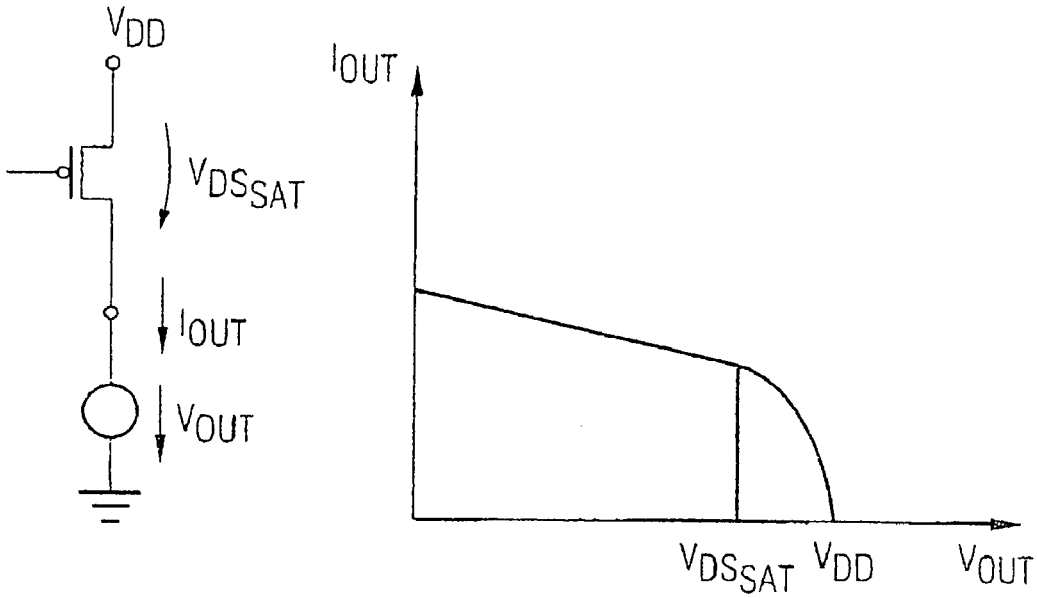
FIG. 7*a*.
Figure 7B:
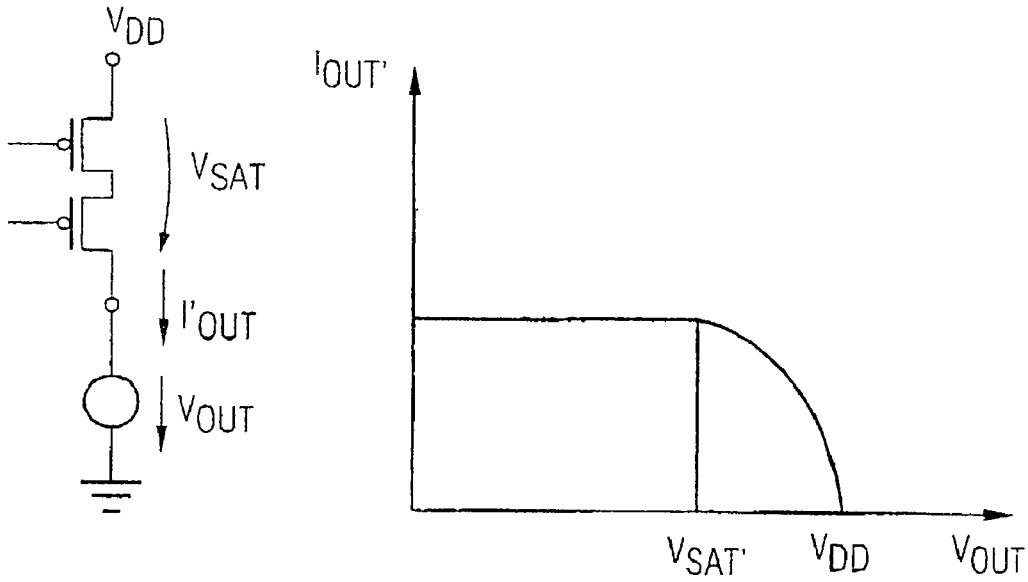
FIG. 7*b* show current/voltage characteristic curves for elucidating the method of operation of the current source according to the invention.

FIGS. 7*a*, 7*b* show current/voltage characteristic curves for elucidating the method of operation of the current source 1 according to the invention. FIG. 7*a* shows a characteristic curve without cascading with a simple current mirror. As can be discerned from FIG. 7*a*, the current/voltage characteristic curve falls approximately linearly as far as a saturation voltage $V_{ds}$ SAT, the gradient of the characteristic curve being inversely proportional to the output resistance of the current source. A typical output resistance is approximately 500 KΩ.

FIG. 7*b* shows the characteristic curve with cascading of the current source. As can be gathered from FIG. 7*b*, the current/voltage characteristic curve runs virtually horizontally up to a threshold voltage set stroke, i.e. the output resistance of the current source 1 is approximately infinite and is typically 50 MΩ. The cascading makes it possible to achieve a considerably higher internal resistance $R_i$ of the current source 1. This in turn is possible due to a reduction of the output voltage $V_A$ of the amplifier stage 5, which, with the supply voltage $V_{DD}$ remaining the same, permits a larger DRAIN-SOURCE voltage $V_{ds}$ of the current mirror stage 12, so that it is possible to provide a cascading stage 14 within the current source 1, as is illustrated for example in FIG. 6.

The current source 1 according to the invention may either be designed in such a way that it manages with a lower supply voltage $V_{DD}$ or, by virtue of the provision of an additional current mirror cascading stage 14, the performance of the current source 1 may be considerably enhanced with the supply voltage $V_{DD}$ remaining the same.

The invention claimed is:

1. A current source for generating a constant reference current, comprising:

an amplifier circuit which outputs a negative feedback voltage present across a first resistor in inverted amplified fashion as an amplifier output voltage;

a first voltage/current converter which generates a current in a manner dependent on the amplifier output voltage;

a first current mirror circuit which mirrors the current generated by the voltage/current converter to form, a mirrored current which flows through the first resistor in order to generate the negative feedback voltage, wherein the first current mirror circuit includes a first MOSFET; and a second current mirror circuit which mirrors the current generated by the voltage/current converter to form the reference current.

wherein the first voltage/current converter includes a MOSFET having a gate connected to an output of the amplifier circuit, a source terminal connected to a negative supply voltage of the current source via a second resistor, and a drain terminal connected to a drain terminal of the first MOSFET of the first current mirror circuit; and wherein the resistance of the second resistor is adjustable.

2. The device of claim 1, wherein the resistance of the second resistor is less than the resistance of the first resistor.

3. The device of claim 2, wherein the second resistor amounts to a short circuit.

4. The device of claim 2, wherein the resistance of the second resistor is half as large as the resistance of the first resistor.

5. A current source for generating a constant reference current, comprising:

an amplifier circuit which outputs a negative feedback voltage present across a first resistor in inverted amplified fashion as an amplifier output voltage;

a first voltage/current converter which generates a current in a manner dependent on the amplifier output voltage;

a first current mirror circuit which mirrors the current generated by the voltage/current converter to form, a mirrored current which flows through the first resistor in order to generate the negative feedback voltage;

a second current mirror circuit which mirrors the current generated by the voltage/current converter to form the reference current;

a respective cascode current mirror circuit connected in parallel with each current mirror circuit; and a second voltage/current converter including a MOSFET having a GATE connected to the output of the amplifier circuit, a SOURCE terminal connected to the negative supply voltage of the current source via a third resistor and a DRAIN terminal connected to a MOSFET constructed in complementary fashion which generates the GATE voltages for the cascode current mirror circuits.

6. The device of claim 5, wherein the current source is integrated into an integrated circuit.

7. The device of claim 1, wherein the amplifier circuit is an inverting amplifier having a first MOSFET at whose gate the negative feedback voltage is present and having a second MOSFET constructed complementarily with respect to the first MOSFET of the amplifier circuit.

8. The device of claim 7, wherein the first MOSFET of the amplifier circuit has a source terminal connected to a negative supply voltage of the current source and a drain terminal connected to an output terminal of the amplifier circuit.

9. The device of claim 7, wherein the second MOSFET of the amplifier circuit has a source terminal connected to a positive supply voltage of the current source, and a drain terminal connected to an output terminal of the amplifier circuit.

10. The device of claim 1, wherein the first MOSFET of the first current mirror circuit has a drain terminal connected to the voltage/current converter and a source terminal connected to a positive supply voltage of the current source.

11. The device of claim 10, wherein the first current mirror circuit has a second MOSFET having a drain terminal connected to the first resistor and a source terminal connected to the positive supply voltage of the current source.

12. The device of claim 10, wherein the gate of the first MOSFET of the first current mirror circuit is connected to the gate of the second MOSFET of the first current mirror circuit.

13. The device of claim 11, further comprising a third current mirror circuit including a first MOSFET having a gate connected to a gate of at least one MOSFET of the first of the first current mirror circuit.

14. The device of claim 13, wherein the gate of the first MOSFET of the third current mirror circuit is further connected to a gate of at least one MOSFET of the second current mirror circuit.

15. The device of claim 1, wherein the resistance of the first resistor is adjustable.

16. The device of claim 1, wherein the first resistor includes polysilicon, and the second resistor includes polysilicon.

17. The device of claim 16, wherein the resistance of the first resistor is adjustable.

18. The device of claim 8, wherein the resistance of the first resistor is adjustable.

19. The device of claim 14, wherein the resistance of the first resistor is adjustable.

20. The device of claim 19, wherein the first resistor includes polysilicon, and the second resistor includes polysilicon.

* * * * *